United States Patent [19]

Gaget

[11] Patent Number: 4,682,423

[45] Date of Patent: Jul. 28, 1987

[54] CENTRIFUGAL DRIER DRUM FOR WET GRANULAR MATERIAL

[75] Inventor: Pierre Gaget, La Mure, France

[73] Assignee: Charbonnages de France, Paris, France

[21] Appl. No.: 854,896

[22] Filed: Apr. 23, 1986

[30] Foreign Application Priority Data

Apr. 26, 1985 [FR] France ..... 85 06402

[51] Int. Cl.[4] ..... F26B 17/30

[52] U.S. Cl. ..... 34/58; 209/267; 209/288

[58] Field of Search ..... 210/407, 408, 314, 318, 210/388; 209/267, 250, 243, 270, 288; 34/8, 58

[56] References Cited

U.S. PATENT DOCUMENTS 3,831,764 8/1974 Humphrey .
3,834,631 9/1974 King .

FOREIGN PATENT DOCUMENTS 1124296 10/1956 France ..... 34/58
2201928 5/1974 France .
352956 4/1961 Switzerland .
379403 8/1964 Switzerland .

*Primary Examiner*—Larry I. Schwartz
*Attorney, Agent, or Firm*—Cushman, Darby & Cushman

[57] ABSTRACT

A centrifugal drier drum for wet granular material has a peripheral drying wall arranged for rotation about its axis and an entry part for receiving the material to be dried and directing this material to within the drum. The entry part is fixed to the wall of the drum by a number of supports. Material fed to the drum impacts the entry part at an impact zone, and is received within the drum at a projection zone. An annular retaining space for retaining the material to be dried is formed at both the impact zone and the projection zone such that the circulating material strikes the surfaces of material retained in these retaining spaces.

11 Claims, 2 Drawing Figures

CENTRIFUGAL DRIER DRUM FOR WET GRANULAR MATERIAL

BACKGROUND TO THE INVENTION

The present invention relates to driers of wet granular material such as, for example, pre-drained coal leaving washing tanks.

Centrifugal driers have a rotatable drum in which an entry part is fixed to form the continuation of a fixed supply duct. The entry parts rotates at high speed together with the drying drum and is arranged to receive material to be dried from the supply duct and to direct this material towards the peripheral drying wall of the drum.

Hitherto, the entry part has generally consisted of a cone section fixed to the base of the drum by several supports. This cone section receives the material to be dried through its narrowest circular opening and directs it towards the drum drying wall through its widest circular opening.

Such a conventional cone section has several drawbacks:

(a) The material to be dried slides over its inner surface with a small degree of friction such that its circular accelerating effect vis-a-vis the material is small. This means that the material is unevenly distributed and "pockets" are formed within the drum, causing undesirable vibration of the drum and inefficient drying of the material.

(b) The material is introduced into the entry part at high speed and therefore causes rapid wear to the entry part which must therefore be frequently replaced.

(c) The supports of the cone section are prone to rapid wear.

(d) The material enters the drying drum at too low a circular speed compared to the speed of this drum. This results in rapid wear of the drum at its impact zone.

It is an object of the invention to reduce the above described drawbacks.

SUMMARY OF THE INVENTION

According to the invention, there is provided centrifugal drier drum comprising a peripheral drying wall arranged for rotation about an axis, an entry part within the drum for receiving material to be dried, and a plurality of supports fixing the entry part within the drum, the entry part having an impact zone and the peripheral drying wall having a projection zone at which material is received, wherein at at least one of said impact and projection zones, an annular retaining space is defined and is arranged during operation to retain a quantity of the material to be dried such that the material defines a surface onto which further material to be dried is deposited.

In a drum of the invention, wear is reduced, and the material to be dried is made to rotate more efficiently until it reaches a speed almost the same as, if not identical to that of the drying drum.

A drum of the invention may have only one or the other of the material retaining spaces, but it is greatly to be preferred for it to be provided with both the retaining spaces.

Preferably, each retaining space has a profile which is substantially triangular in cross-section such that the material retained therein forms a natural slope with a thickness which decreases parallel to the drum axis.

In this way, the material arriving and circulating through the drum successively encounters the material contained in each of the retaining spaces, this effectively protecting both the entry part and the peripheral wall against wear. Moreover, the considerable degree of friction which occurs between the material which is supplied via the fixed duct and the material contained in the retaining space at the impact zone results in the material being made to rotate in a suitable manner before being projected against the peripheral drying wall. This produces better distribution of the material and a considerable reduction in vibration.

In one embodiment of the invention, the entry part comprises, a ring arranged coaxially relative to the drying drum in a plane substantially perpendicular to the drum axis, the ring having an internal peripheral edge, intended to surround a duct supplying the material to be dried, and an external peripheral edge, and a cylindrical wall extending in the direction of material flow from a point on the said ring spaced from its internal peripheral edge, preferably from its external peripheral edge.

Preferably, the supports of the entry part are fixed to the cylindrical wall of the entry part and to the peripheral wall of the drum.

The ratio between the width of the ring, in the radial direction, and the length of the cylindrical wall, in the longitudinal direction, determines the gradient of the slope formed by the material residing in the retaining space. This ratio must be adjusted in accordance with the nature of the material to be dried so that rotation of the flowing material as a result of friction with the material contained in the retaining space occurs in a suitable manner.

As has been mentioned, when the material to be dried leaves the slope formed by the material contained in the retaining space, it is projected beyond one edge of the entry part against the peripheral wall of the drum in the projection zone. Advantageously, the supports for fixing the entry part to the drum are situated downstream of the said edge and the projection zone. Preferably, an annular partition is arranged in a substantially transverse plane downstream of this same edge and of the projection zone, with an external peripheral edge in contact with the peripheral wall of the drum and an internal peripheral edge located at a distance from the cylindrical wall of the entry part.

This annular partition defines a second annular retaining space provided so as to extend as far as the projection zone and so as to contain some of the material to be dried so that the circulating material is projected onto the material which has been retained.

This annular partition may be fixed directly to the peripheral wall of the drum. As it is not desirable to reduce the useful drying life of the peripheral wall of the drum, it is preferable to place the transverse partition as close as possible downstream of the projection zone and the free annular edge defined above.

In an embodiment, the annular partition defining the second retaining space is a flat plate arranged in a plane perpendicular to the axis of the drying drum, between the free annular edge and the support. Preferably, this flat plate is arranged against the supports.

BRIEF DESCRIPTION OF THE DRAWINGS

An embodiment of the present invention will hereinafter be described, by way of example, with reference to the accompanying drawings, in which.

DESCRIPTION OF PREFERRED EMBODIMENTS

The drawings illustrate examples of centrifugal drier drums to which material to be dried is conveyed by way of a fixed curved duct 1 which supplies an entry part 2.

Figure 1:
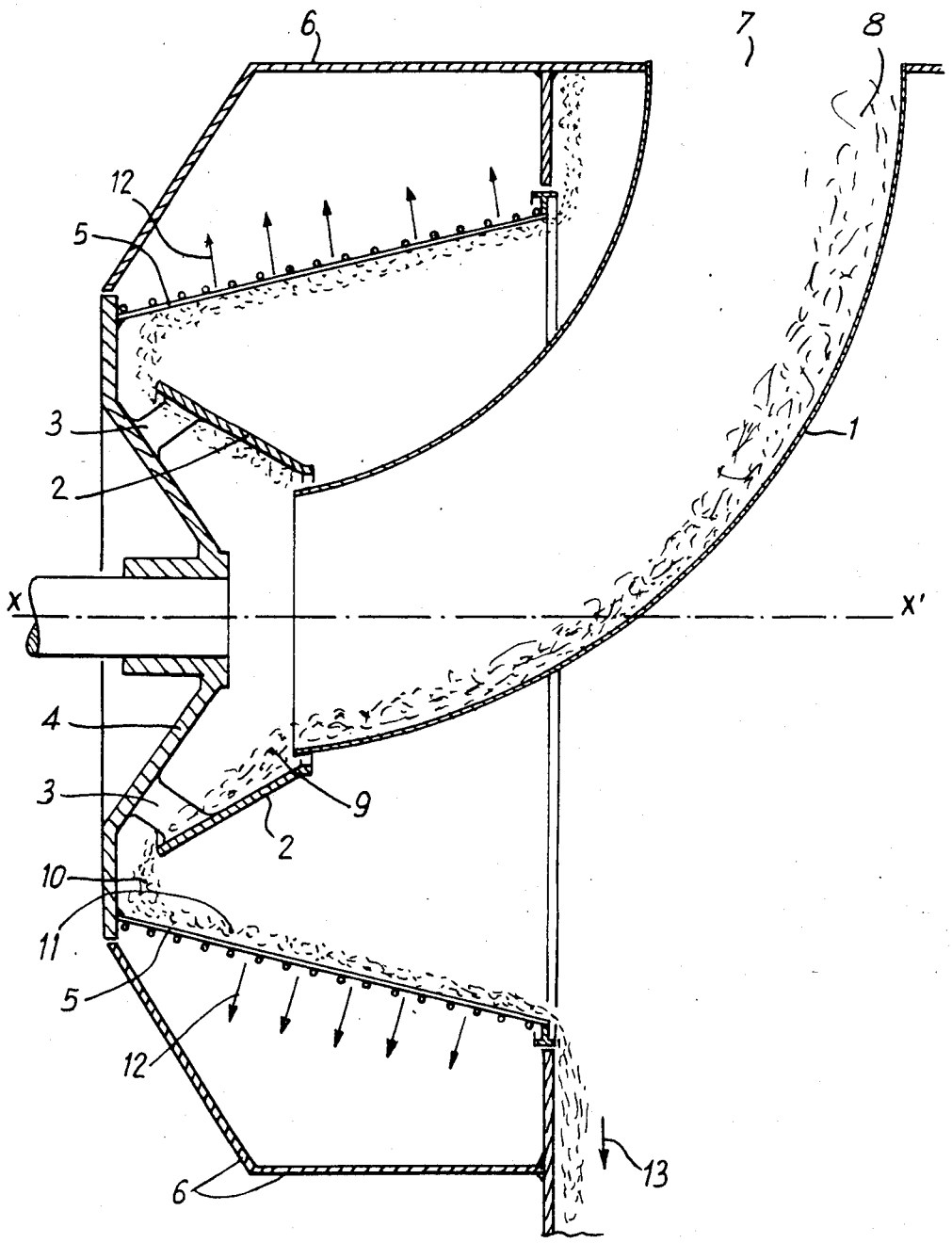
FIG. 1 is a diagrammatic view, in meridional section along the axis XX', of the centrifugal drier drum having an entry part of a known type.

FIG. 1 illustrates a known entry part 2 formed of a metal cone section having an axis XX' and being joined, by way of supports 3, to the bottom 4 of a drying drum. The drum is arranged to be rotated at high speed, for example, at 450 revolutions/minute, about the axis XX'.

The drum has a tapered peripheral drying wall 5 which has a multiplicity of small openings. The drum is rotated within a fixed housing 6 to which the duct 1 is fixed in the region of its opening 7.

A material 8 to be dried is introduced into the drier drum by way of the duct opening 7. In the present example, the material to be dried is pre-drained granular coal from coal washing tanks. The material flows, by means of gravity, inside the duct 1 into the middle of the drum.

In the arrangement shown in FIG. 1, the material comes into contact, at an impact zone 9, with the entry part 2 which is rotated at high speed with the drum. This entry part 2 has the shape of a truncated cone, and only subjects the material to a very small degree of frictional force. The circumferential acceleration of the said material is therefore insufficient. The main outcome is that the material is distributed in pockets within the drum. Moreover, the supports 3 which rotate together with the drum strike the material and disperse it in a disorderly manner. All this results in vibration of the drum and poor drying conditions.

Moreover, with such an entry part 2, the drier drum has three zones which are subject to considerable and rapid wear, namely the cone section 2, the supports 3, and a projection zone 10 on the peripheral wall 5 of the drum against which the material within the drum is projected by the centrifugal force when it leaves the entry part 2. Because of its impact with the projection zone 10, the material leaves the entry part 2 with an inadequate circumferential speed compared to that of the drum.

Because of the rotation of the drum, the material from the entry part 2 travels along the entire length 11 of its peripheral wall 5. Dried material is discharged downwardly at 13, whilst the water and the sludge pass through the drum wall, over the entire surface of the drying section 5, as indicated by the arrows 12, and are then discharged via an opening (not shown) provided in the housing 6.

Figure 2:
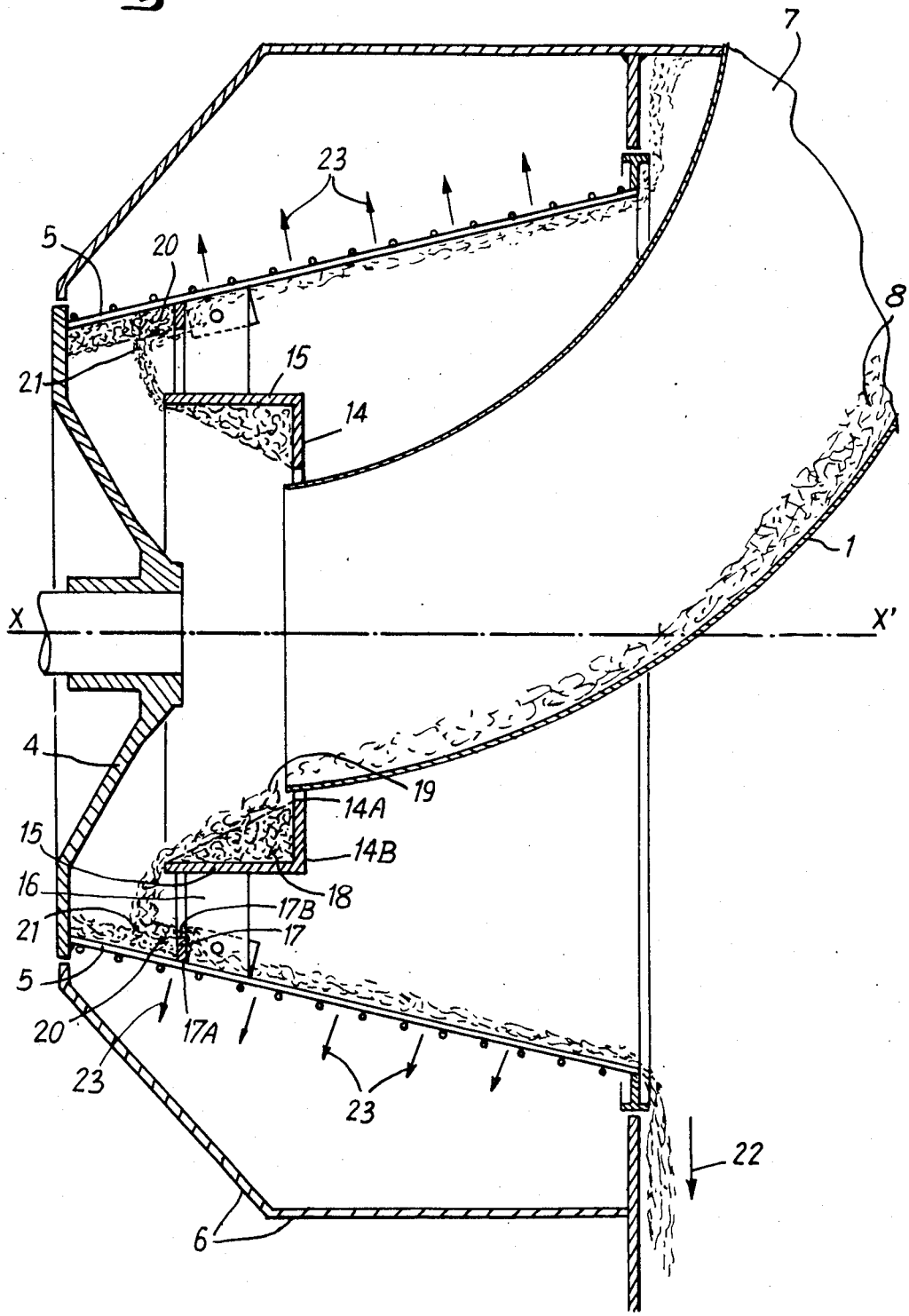
FIG. 2 is a view, in meridional section along the axis XX', of a similar centrifugal drier drum to that of FIG. 1, but having a different entry part.

Reference will now be made to FIG. 2 which illustrates a drier drum of the invention. In FIGS. 1 and 2, the same reference numbers have been used to denote similar parts.

In the drum shown in FIG. 2, the entry part comprises a flat ring 14 arranged in a transverse plane perpendicular to the axis XX' of the drier drum. This ring is made of sheet metal having a thickness of 10 mm and it has an internal peripheral edge 14A which surrounds the fixed duct 1 and an external peripheral edge 14B. A cylindrical wall 15, also made of 10 mm thick sheet metal, extends from the external edge 14B of the ring 14 towards the bottom 4 of the drum but is spaced from this bottom 4. The wall 15 is concentric with the axis XX' and is preferably joined to the ring 14 by a welded joint at the contacting edges of the ring and the wall 14.

Circumferentially spaced supports 16 extend radially with respect to the axis XX' between the external surface of the cylindrical wall 15 and the peripheral wall 5 of the drum.

An annular partition formed by a flat ring 17 arranged in a transverse plane perpendicular to the axis XX' is located against the supports 16. The ring 17 is positioned on the upstream end edge of the supports 16 which is opposite the bottom 4 of the drum. This flat ring 17 has an external peripheral edge 17A in contact with the peripheral wall 5 of the drum and an internal peripheral edge 17B which is located at a considerable distance from the cylindrical wall 15. The flat ring 17 can be directly welded to the peripheral wall 5 of the drum. Alternatively, the ring 17 can be welded to the supports 16 so that it forms part of the entry piece, it being positioned with its external edge 17A against the peripheral wall 5 when the entry part is positioned within the drum. Since the entry part is a part prone to wear, the supports 16 are generally fixed by means of bolts (not shown) to the peripheral wall 5 of the drum, so that the entry part can be easily removed and replaced.

The cylindrical wall 15 ends in a free circular edge 15A which is located opposite the bottom 4 of the drum. The supports 16 and the flat ring 17 are set back in relation to this free edge 15A, in the direction of the flow of material.

During operation, the drum provides two spaces for retaining the material to be dried, which greatly reduce, or even eliminate, the wear of the most exposed zones. These spaces also enable improvement of the rotational movement imparted to this material before it reaches the drum. These improvements will now be explained.

At the start of a drying operation, some of the material arriving by way of the fixed duct 1 is retained within an annular space 18 which has a triangular cross-section and is defined by the flat ring 14 and the cylindrical wall 15.

In the space 18 which is, in a conventional entry part as shown in FIG. 1, the zone where the material strikes the entry part, the material collects and permanently forms a rotating slope having an inclined surface 19 over which the material arriving by way of the fixed duct 1 flows. The friction between the flowing material 9 and the material within the space 18 is sufficiently great that a considerable circumferential speed is imparted to the flowing material as it flows out beyond the free circular edge 15A of the cylindrical wall 15.

As it passes over the free circular edge 15A, the material is projected onto the cylindrical wall 5 of the drum in a zone which is the projection zone 10 on the conventional drum shown in FIG. 1. Because of the transverse flat ring 17, some of the material which travels along the cylindrical wall 5 is retained within an annular space 20 defined by this cylindrical wall 5 and the ring 17. In this retaining space the material forms an annular slope, onto the surface 21 of which the material arriving inside the drum is projected. The material then flows over the ring 17 and continues its journey along the peripheral drying wall 5.

The material is dried over the entire surface of the wall 5 of the drum, the dried material being discharged downwardly at 22, whilst the water and sludge exit in the direction of the arrows 23 and are then discharged via an opening (not shown) in the housing 6.

The advantages of a drum of the invention are numerous.

Firstly, the entry part is very simple to construct, using welded sheet metal for example, and, consequently, it is inexpensive.

The natural slopes of the material retained within the spaces 18 and 20 during operation absorb the impact of the flowing material, and this provides two advantages. First, the entry part is subject to very little wear and secondly the high degree of friction between the flowing material and the retained material causes an even distribution of the flowing material within the drum. Additionally, the flowing material rapidly attains a considerable circumferential speed. Thus, the formation of pockets of material and vibration of the drum are prevented, and the drying conditions are improved.

In tests, drying pre-drained coal from coal washing tanks, using a drier as shown in FIG. 2, reduced by 1% to 2% the moisture content of the product collected at the outlet 22 and produced a large degree of uniformity of this content compared to the same product dried in a conventional drum as shown in FIG. 1.

Another important advantage of the invention is that the impact of the flowing material against the supports 16 is much less violent than against the supports 3 of a conventional drum because of the new position of these supports 16 and because the improved circumferential acceleration of the flowing material ensures that the rotational speed of the material and of the supports are almost the same when impact occurs. Consequently, the supports 16 are subject to much less rapid wear than the supports 3 and, impact no longer causes disorderly and unequal dispersion of the material, which prevented a good drying action in known driers.

Another advantage of the invention arises from the formation of the second retaining space 20 by the transverse ring 17. The presence in the space 20 of material which receives the projected material increases a service life of the drum to a value which is more than double that of a conventional drum.

To summarise, the main advantages of the invention are an increase in the quality and uniformity of the drying action, an increase in the service life of the entry part and an increase in the service life of the drying drum.

Driers equipped with a drum of the invention are particularly useful for processing the products from small-coal washing tanks. However, they can also be used for most industrial products which must be dried.

I claim:

1. Centrifugal drier drum comprising a peripheral drying wall arranged for rotation about an axis, an entry part within the drum for receiving material to be dried, and a plurality of supports fixing the entry part within the drum, the entry part having an impact zone and the peripheral drying wall having a projection zone at which material is received, wherein at least one of said impact and projection zones, an annular retaining space is defined and is arranged during operation to retain from the circulating material to be dried on the travel path thereof a quantity of said material such that the retained material defines a surface onto which the further incoming material to be dried is projected.

2. A drum according to claim 1, wherein the cross-sectional profile of the or each annular retaining space is substantially triangular and the material contained therein during operation forms a natural slope with a thickness which decreases parallel to the axis.

3. A drum according to claim 1, having both an annular retaining space in the impact zone of the entry part and in the projection zone of the peripheral wall.

4. A drum according to claim 1, wherein said entry part comprises a ring arranged about said drum axis in a plane substantially perpendicular to the said axis, said ring having an internal peripheral edge and an external peripheral edge, and a cylindrical wall extending in the direction of material flow from said ring so as to terminate in a free edge, the ring and the cylindrical wall defining a first retaining space at the impact zone.

5. A drum according to claim 4, wherein said cylindrical wall extends from the external peripheral edge of said ring.

6. A drum according to claim 4, wherein said supports are fixed to said cylindrical wall and to the peripheral wall.

7. A drum according to claim 4, comprising an annular partition arranged substantially in a transverse plane and in contact with the peripheral wall, said peripheral wall and said partition, together defining a second retaining space at the projection zone, and wherein said annular partition is formed by a flat ring arranged between the transverse plane containing the free edge of said cylindrical wall and the plane containing said ring, an external peripheral edge of the annular partition being in contact with the peripheral wall and an internal peripheral edge of said partition being spaced from the cylindrical wall.

8. A drum according to claim 7, wherein said supports are set back relative to the free edge of said cylindrical wall in the direction of material flow and the annular partition is arranged between the transverse plane containing this free edge and the support.

9. A drum according to claim 8, wherein the annular partition is arranged against the supports.

10. Centrifugal drier drum comprising a peripheral drying wall arranged for rotation about an axis, an entry part within the drum for receiving material to be dried, and a plurality of supports fixing the entry part within the drum, the entry part having an impact zone and the peripheral drying wall having a projection zone at which material is received, wherein at least one of said impact and projection zones, an annular retaining space is defined and is arranged during operation to retain a quantity of the material to be dried such that the material defines a surface onto which further material to be dried is deposited; said entry part comprising a ring arranged about said drum axis in a plane substantially perpendicular to said axis, said ring having an internal peripheral edge and an external peripheral edge and a cylindrical wall extending in the direction of material flow from said ring so as to terminate in a free edge, the ring and the cylindrical wall defining a first retaining space at the impact zone.

11. Centrifugal drier drum comprising a peripheral drying wall arranged for rotation about an axis, an entry part within the drum for receiving material to be dried, and a plurality of supports fixing the entry part within the drum, the entry part having an impact zone and the peripheral drying wall having a projection zone at which material is received, wherein at least one of said impact and projection zones, an annular retaining space is defined and is arranged during operation to retain a quantity of the material to be dried such that the material defines a surface onto which further material to be dried is deposited, an annular partition arranged substantially in a transverse plane and in contact with the peripheral wall, said peripheral wall and said partition together defining a second retaining space at the projection zone.

* * * * *